US011241093B2

(12) United States Patent
Viger

(10) Patent No.: US 11,241,093 B2
(45) Date of Patent: Feb. 8, 2022

(54) ZERO GRAVITY CHAIR MECHANISM

(71) Applicant: Denis Viger, Magog (CA)

(72) Inventor: Denis Viger, Magog (CA)

( * ) Notice: Subject to any disclaimer, the term of this patent is extended or adjusted under 35 U.S.C. 154(b) by 0 days.

(21) Appl. No.: 15/932,740

(22) Filed: Apr. 19, 2018

(65) Prior Publication Data

US 2018/0303239 A1 Oct. 25, 2018

Related U.S. Application Data

(60) Provisional application No. 62/602,263, filed on Apr. 19, 2017.

(51) Int. Cl.

| | |
|---|---|
| ***A47C 1/024*** | (2006.01) |
| ***A47C 1/02*** | (2006.01) |
| ***A47C 7/00*** | (2006.01) |

(52) U.S. Cl.

CPC ..... *A47C 1/0242* (2013.01); *A47C 1/02* (2013.01); *A47C 7/002* (2013.01)

(58) Field of Classification Search

CPC ..... A47C 1/0242; A47C 1/02; A47C 7/002
USPC ..... 297/85 M
See application file for complete search history.

(56) References Cited

U.S. PATENT DOCUMENTS

| | | | | |
|---|---|---|---|---|
| 8,915,544 | B2 * | 12/2014 | LaPointe | A61G 5/14 297/85 M |
| 9,743,770 | B1 * | 8/2017 | Pollard | A47C 1/0355 |
| 2014/0368011 | A1 * | 12/2014 | LaPointe | A61G 5/14 297/316 |
| 2015/0076891 | A1 * | 3/2015 | LaPointe | A47C 31/008 297/85 M |
| 2018/0228290 | A1 * | 8/2018 | Kiwak | A47C 1/0352 |

* cited by examiner

*Primary Examiner* — Anthony D Barfield
(74) *Attorney, Agent, or Firm* — Cassan MacLean IP Agency Inc.

(57) ABSTRACT

A zero gravity chair mechanism includes a frame having a bottom wall and a pair of vertical side walls; a carriage slidable longitudinally of the bottom wall; a linear actuator for moving the carriage longitudinally of the frame; link arms connected to the carriage for movement with the carriage, front ends of the link arms being connected to chair seat support brackets for moving the brackets longitudinally of the frame, the rear of the brackets moving horizontally while the rear of the brackets move upwardly and rearwardly relative to the frame or downwardly and forwardly relative to the frame, whereby the chair moves between a horizontal position and a zero gravity position. During movement from the zero gravity to the horizontal positions, the back of the chair moves downwardly and forwardly relative to the frame.

2 Claims, 5 Drawing Sheets

ZERO GRAVITY CHAIR MECHANISM

This invention relates to a zero gravity chair mechanism.

More specifically, the invention relates to a mechanism for supporting a reclining chair seat and attached back so that the chair can be positioned relatively close to a wall in the upright position and reclined to the zero gravity position without moving the chair away from the wall. In the zero gravity position, the knees of the chair occupant are at the same level or slightly above the level of the head.

Mechanisms for use in zero gravity chairs or reclining chairs of the so-called wall-hugger type are by no means new. An example of such a mechanism is described in U.S. Pat. No. 7,311,359, issued to Nathaniel Smith on Dec. 25, 2007. For the most part, such mechanism rely on somewhat complicated, multi-component linkages. Accordingly a need exists for a simple zero gravity chair mechanism, which does not rely on complicated linkages.

The present invention provides a relatively simple mechanism for supporting the seat of a zero gravity chair which includes relatively few elements and is easy to manufacture. In its simplest form, the zero gravity chair mechanism of the present invention includes a frame having a bottom wall and a pair of parallel, spaced apart side walls extending upwardly from side edges of the bottom wall; a carriage slidable longitudinally of the bottom wall between the side walls; a linear actuator connected to the carriage for moving the carriage longitudinally of the bottom wall; a crossbar on said carriage extending outwardly from each side of the carriage to positions proximate the frame side walls; horizontal link arms extending forwardly from ends of said crossbar; longitudinally extending, horizontal slots in front ends of the frame side walls; first bolts extending through front ends of said link arms and said horizontal slots, the first bolts being slidable in the horizontal slots between front positions and rear positions; brackets for supporting a chair, the bolts extending through front ends of the brackets, whereby movement of the first bolts in the horizontal slots results in a corresponding movement of the front ends of the brackets; inclined slots in rear ends of the frame sides; and second bolts extending through the inclined slots and rear ends of the seat brackets, whereby movement of the carriage longitudinally of the frame causes the brackets to move between the front, horizontal positions and rear inclined positions, and movement of the chair back between front horizontal positions and rear inclined positions with respect to the frame.

The invention is described below in greater detail with reference to the accompanying drawings, which illustrate preferred embodiments of the invention, and wherein.

Figure 1:
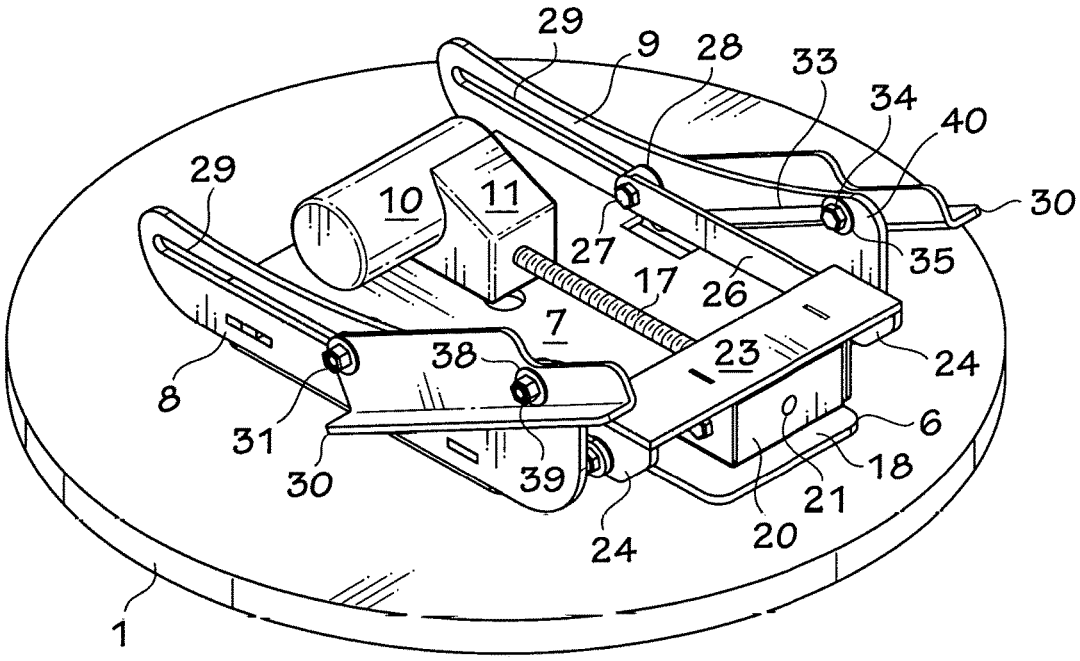
FIGS. 1 and 2 are isometric views of a zero gravity chair mechanism in accordance with the present invention.

With reference to FIGS. 1 to 7 of the drawings, the zero gravity chair mechanism is mounted on a base defined by a circular baseplate 1 and a turntable 2 rotatable on the baseplate 1. The turntable 2 includes a square bottom plate 3, a cylindrical bearing assembly 4 extending upwardly from the bottom plate 3 and a square top plate 5 carrying the mechanism of the present invention. The chair mechanism can be mounted on a non-rotatable or other base differing from that shown in the drawings.

Figure 2:
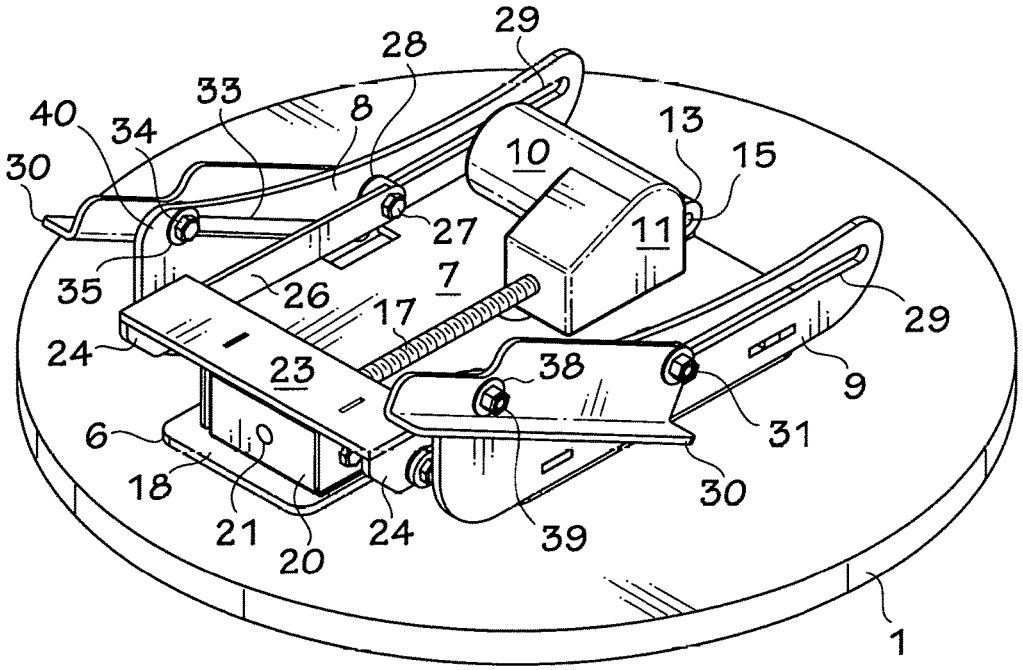
Figure 3:
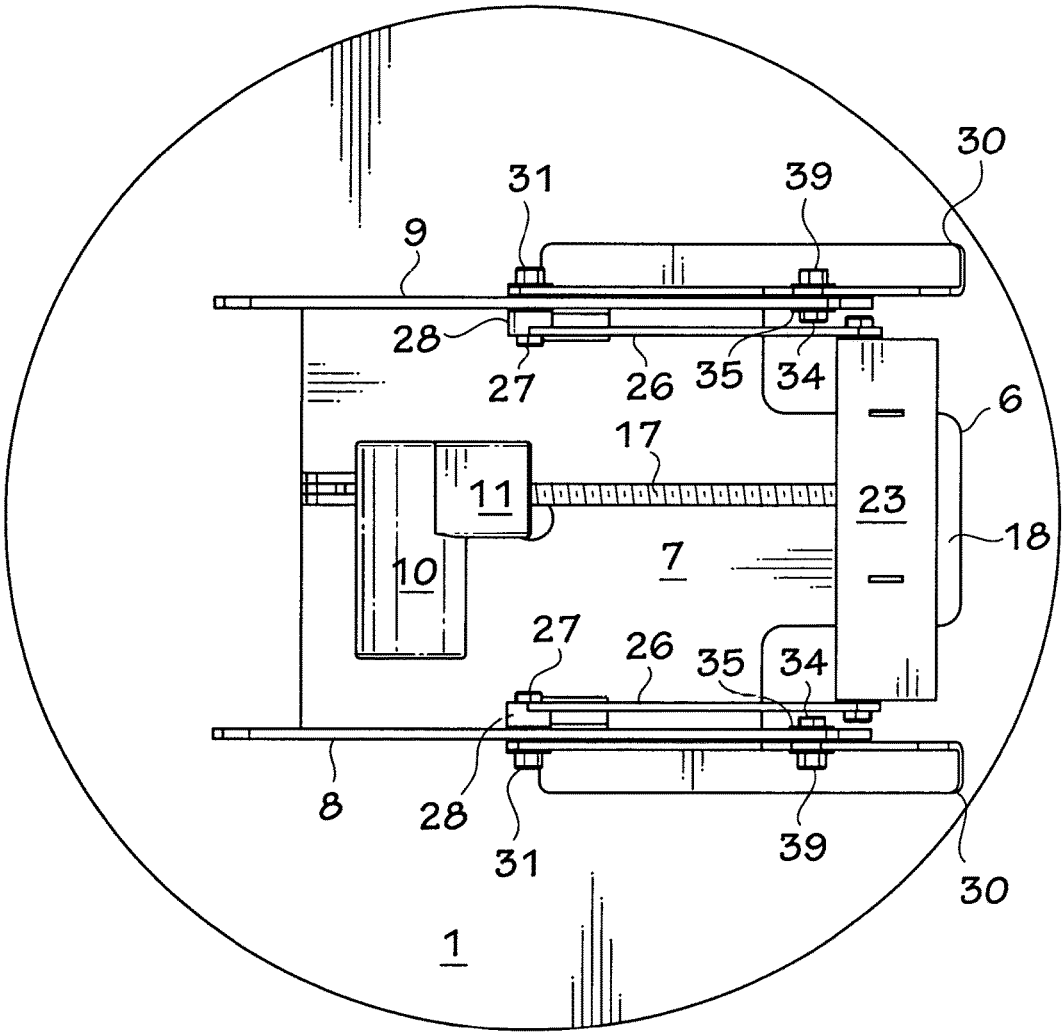
FIG. 3 is a top view of the chair mechanism of FIGS. 1 and 2.
Figure 4:
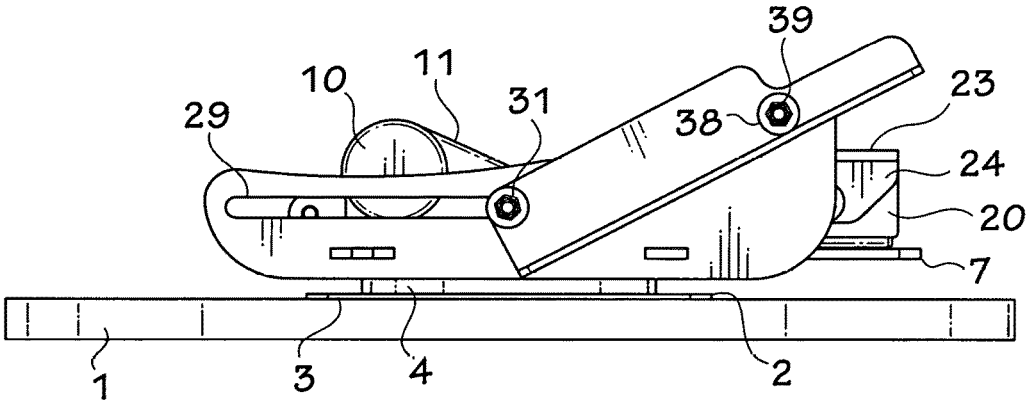
FIGS. 4 and 5 are side views of the chair mechanism of FIGS. 1 to 3.
Figure 5:
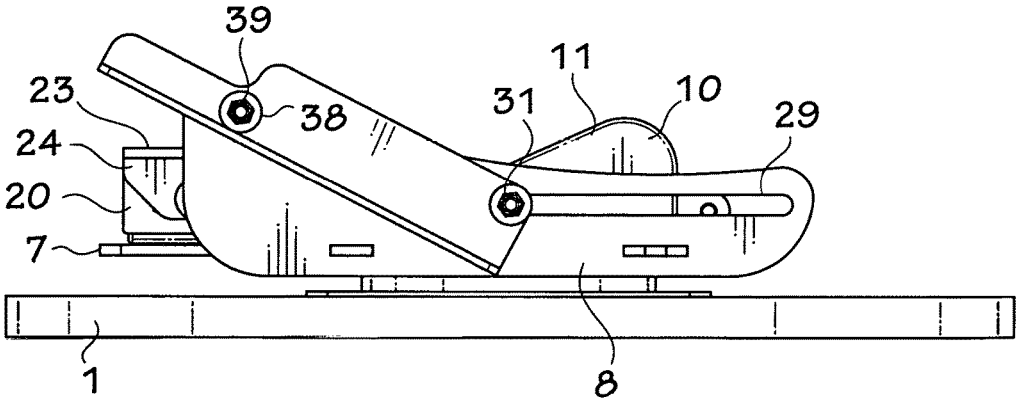
Figure 6:
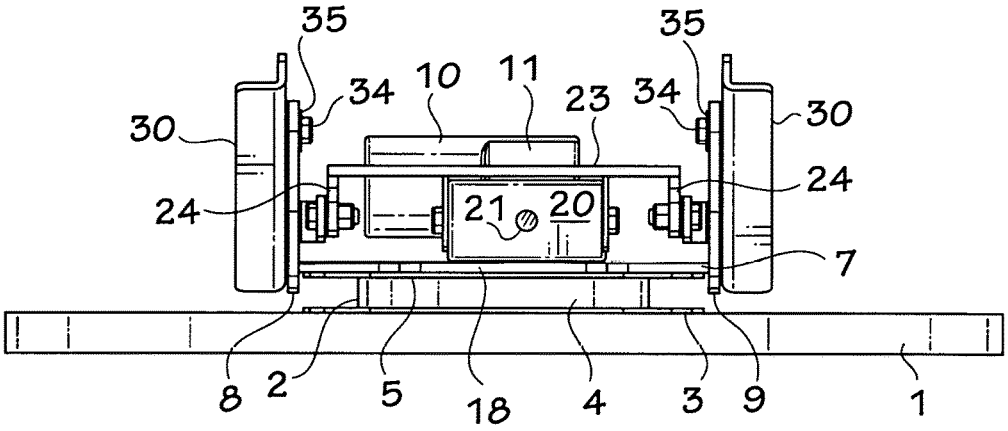
FIGS. 6 and 7 are front and rear views.
Figure 7:
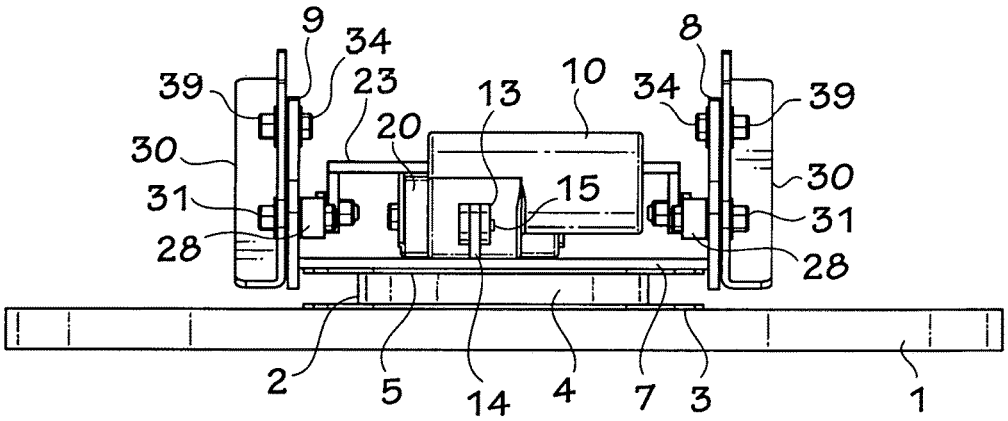

The chair mechanism includes a frame 6 defined by a bottom wall 7 and a pair of side walls 8 and 9 connected to the bottom wall 7. The motor 10 and transmission 11 of a linear actuator are mounted on the bottom wall 7 near the front end thereof. The motor 10 is secured on the bottom wall 7 by a clevis 13 (FIGS. 2 and 3) extending outwardly from the back of the motor, a small post 14 extending upwardly from the bottom wall 7 and a pin 15 (FIG. 2). A suitable actuator is available from Quindao Richriver Electronics Co. Ltd., Quindao, China. A threaded shaft 17, which is part of the linear actuator, extends out of the transmission 11 toward the rear end 18 of the bottom wall 7 of the frame. A carriage 20 with a threaded hole 21 therethrough is mounted on the shaft 13 for longitudinal sliding movement along the bottom wall 7 when the motor 10 is operated.

Figure 8:
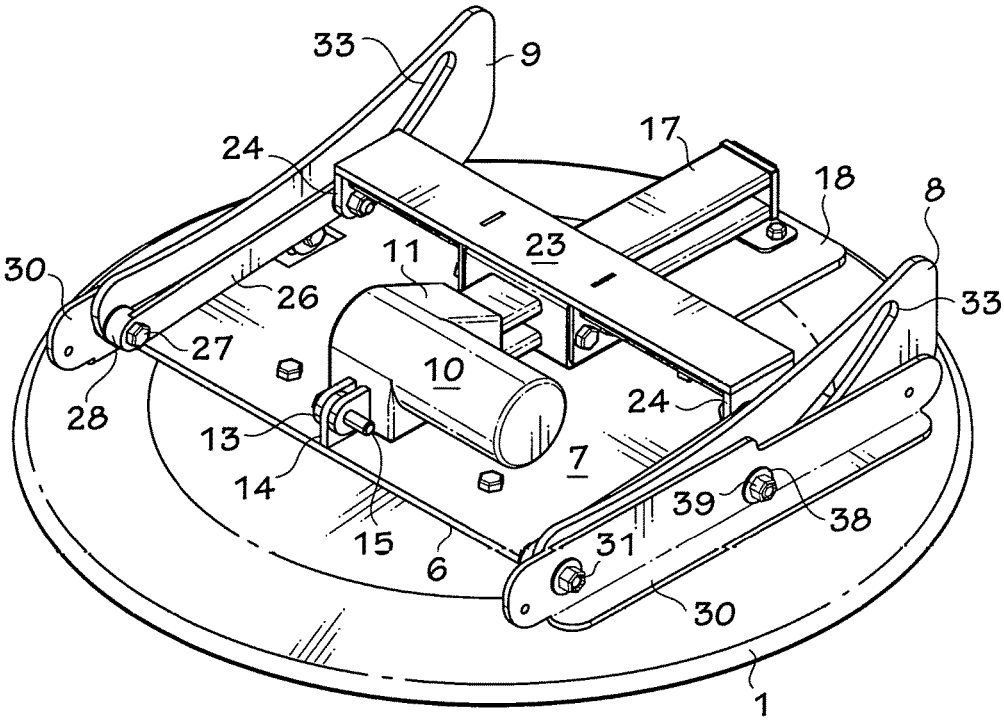
FIG. 8 is an isometric view of a second embodiment of the chair mechanism of the present invention.

A crossbar 23 is mounted on the carriage 20. The crossbar 23 extends beyond the ends of the carriage 20 to locations proximate the side walls 8 and 9 of the frame 6. An ear 24 extends downwardly from each end of the crossbar 23. The rear end of a link arm 26 is connected to each ear 24 for movement with the carriage 20. Bolts 27 extend through the rear ends of the link arms 26, bushings 28, longitudinally extending slots 29 in the front ends of the frame sides 8 and 9, and the upper rear ends of brackets 30 into nuts 31. The brackets 30 are L-shaped in cross section, and are intended to carry a reclining chair (not shown). When the actuator 10 is operated, the carriage 20 slides longitudinally on the bottom wall 7 of the frame 6, and the crossbar 23, link arms 26 and brackets 30 move forwardly or rearwardly with the link arms 26. Second slots 33 (FIGS. 1 and 2) are provided in the rear section of the frame side walls 8 and 9. The slots 33 are inclined upwardly from their front ends to their rear ends. The front ends (not shown) of the slots 33 are slightly below the level of the horizontal slots 29 so that in the vertical chair back position, the seat of the chair and the brackets 30 are roughly horizontal and parallel to the base plate 1 (FIG. 8). It is appreciated that the back of the chair is not actually vertical in the vertical chair back position. Rather the chair back is slightly inclined with respect to the vertical, but for ease of description the slightly inclined position of the back is referred to as "vertical". A bolt 34 extends through a washer 35, the slot 33, the bracket 30 and a second washer 38 into a nut 39.

Figure 9:
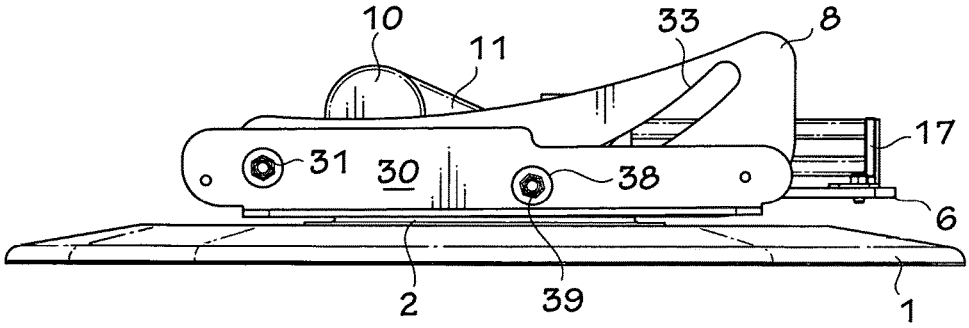
FIG. 9 is a side view of the chair mechanism of FIG. 8.

FIGS. 8 and 9 illustrate a second embodiment of the invention which is virtually identical to the mechanism of FIGS. 1 to 7. Accordingly, the reference numerals used in FIGS. 1 to 7 are also used to identify the same or similar elements in FIGS. 8 and 9.

All of the elements of the second embodiment of the invention are the same as those in the mechanism of FIGS. 1 to 7, except that the linear actuator 17 is a different model available from Quindao Richriver Electric Co. Ltd., and the rear, inclined slots 33 are arcuate, curving upwardly and rearwardly to locations proximate the higher rear ends 40 of the frame sides 8 and 9. The use of arcuate slots 33 curving rearwardly and upwardly makes it easier for the bolts 34 to start moving in the slots.

The linkages (not shown) between the brackets 30 and the chair are such that when the brackets are in the horizontal position (FIGS. 8 and 9), the chair seat is in the horizontal position. When the actuator is operated, the carriage 20 moves along with the crossbar 23 and the link arms 26. The link arms 26 draw the brackets 30 rearwardly and simultaneously the bolts 34 slide upwardly and rearwardly in the slots 33 to tilt the brackets 30 and consequently the chair seat and the attached back. The slots 29 and 33 are sufficiently long and the upper ends of the slots 33 are sufficiently higher than the slots 30 that when the brackets 30 are in the rearmost position (FIGS. 1 to 7), the chair seat and any attached back and foot rest are in the zero gravity positions. When the actuator is operated in reverse, the link arms 26 draw the seat brackets 30 forward. As the brackets 30 move forward, their rear ends and the rear of the chair back move forward and downward. Thus, if the chair is close to a wall, the chair back is simultaneously tilted toward the horizontal and moved away from the adjacent wall as the carriage 20 moves forward.

The invention claimed is:

1. A zero gravity chair mechanism comprising a frame having a bottom wall and a pair of parallel, spaced apart side walls extending upwardly from side edges of the bottom wall; a carriage slidable longitudinally of the bottom wall between the side walls; a linear actuator connected to the carriage for moving the carriage longitudinally of the bottom wall; a crossbar on said carriage extending outwardly from each side of the carriage to positions proximate the frame side walls; horizontal link arms extending forwardly from ends of said crossbar; longitudinally extending, horizontal slots in front ends of the frame side walls; first bolts extending through front ends of said link arms and said horizontal slots, the first bolts being slidable in the horizontal slots between front positions and rear positions; brackets for supporting the sides of a chair seat, the bolts extending through front ends of the brackets, whereby movement of the first bolts in the horizontal slots results in a corresponding movement of the front ends of the brackets; inclined slots in rear ends of the frame sides; and second bolts extending through the inclined slots and rear ends of the seat brackets, whereby movement of the carriage longitudinally of the frame causes the brackets to move between the front, horizontal positions and rear inclined positions, and movement of the chair back between front horizontal positions and rear inclined positions with respect to the frame.

2. The zero gravity chair mechanism of claim 1, wherein the horizontal slots extend from positions proximate front ends of the frame side walls to locations proximate the middles of the side walls, and the inclined slots have bottom ends rearwardly and beneath the rear ends of the horizontal slots and top ends proximate the rear ends of the frame side walls.

* * * * *